US008436241B2

(12) United States Patent
Yamashita et al.

(10) Patent No.: US 8,436,241 B2
(45) Date of Patent: May 7, 2013

(54) BEAT ENHANCEMENT DEVICE, SOUND OUTPUT DEVICE, ELECTRONIC APPARATUS AND METHOD OF OUTPUTTING BEATS

(75) Inventors: Kosei Yamashita, Kanagawa (JP); Yasuhide Hosoda, Tokyo (JP)

(73) Assignees: Sony Corporation, Tokyo (JP); Sony Computer Entertainment Inc., Tokyo (JP)

( * ) Notice: Subject to any disclaimer, the term of this patent is extended or adjusted under 35 U.S.C. 154(b) by 526 days.

(21) Appl. No.: 12/114,903

(22) Filed: May 5, 2008

(65) Prior Publication Data

US 2008/0276793 A1 Nov. 13, 2008

(30) Foreign Application Priority Data

May 8, 2007 (JP) ..... 2007-123831

(51) Int. Cl.
*G10H 1/40* (2006.01)
*G10H 7/00* (2006.01)

(52) U.S. Cl.
USPC ..... 84/611

(58) Field of Classification Search ..... 84/611, 84/626, 635; 601/47
See application file for complete search history.

(56) References Cited

U.S. PATENT DOCUMENTS

| | | | | |
|---|---|---|---|---|
| 6,027,463 | A * | 2/2000 | Moriyasu | 601/46 |
| 2007/0055096 | A1 * | 3/2007 | Berry et al. | 600/38 |
| 2007/0255739 | A1 * | 11/2007 | Miyajima et al. | 707/101 |

FOREIGN PATENT DOCUMENTS

| | | |
|---|---|---|
| JP | 5-49080 | 2/1993 |
| JP | 6-51757 | 2/1994 |
| JP | 11-212551 | 8/1999 |
| JP | 2002-278547 | 9/2002 |
| JP | 2004-227638 | 8/2004 |
| JP | 2007-33851 | 2/2007 |
| JP | 2007-033851 | 2/2007 |

OTHER PUBLICATIONS

Notification of Reason(s) for Refusal dated Mar. 3, 2009, from the corresponding Japanese Application.
Notification of Reason(s) for Refusal dated Jan. 5, 2010, from the corresponding Japanese Application.

* cited by examiner

*Primary Examiner* — Jeffrey Donels
(74) *Attorney, Agent, or Firm* — Katten Muchin Rosenman LLP

(57) ABSTRACT

In a sound output device, a sound input unit acquires a sound signal reproduced by a reproduction device. A beat extractor extracts a beat component of the sound signal based on a spectrogram, and generates a beat waveform having information of a beat timing and a beat intensity. An output signal generator amplifies the sound signal with the beat waveform being a gain, using the beat timing and beat intensity which the beat waveform has. A sound output unit outputs the beat enhanced sound signal as a sound by performing D/A conversion on the beat enhanced sound signal.

6 Claims, 10 Drawing Sheets

BEAT ENHANCEMENT DEVICE, SOUND OUTPUT DEVICE, ELECTRONIC APPARATUS AND METHOD OF OUTPUTTING BEATS

BACKGROUND OF THE INVENTION

1. Field of the Invention

The present invention relates to a sound processing technique, in particular, to a beat enhancement device, a sound output device, and an electronic apparatus, which perform predetermined processing on a sound signal, such as music, and output the processed signal, and further to a beat outputting method which is applied to the devices.

2. Description of the Related Art

Because of the technical background in which the technology of coding sound data has been developed, memory devices have been larger in capacity and smaller in size, and ways of acquiring data have diversified or the like, sound data are now produced in diversified environments, which enable people to easily enjoy sense of being there with a 5.1 channel surround system, or enjoy many types of music wherever you want by storing a large amount of data in a mobile audio player.

Similarly, the technology in which certain types of processing are performed on music which are once recorded or performed has been used widely, in addition to the technology which enables people to listen to music contents acquired in a non-interactive manner. For example, sound quality is improved by performing various processings on music using sound-processing software such as equalizers. A completely different music is created by remixing multiple pieces of music. With the technology, ways of enjoying music are increasingly diversified.

Sound quality adjustment of a sound signal is generally carried out by changing the frequency characteristic of a sound. For example, a low frequency sound is enhanced so that a deeper sound or a more powerful sound can be heard. That is, enhancement or extraction of components included in a sound signal is often done for individual frequency bands. On the other hand, music genres have currently diversified from grand classical music or soundtracks to hip-hop music or dance music in which the rhythm is important, and features each music genre has are greatly different from one another.

Naturally, music with different features have different components desired to be enhanced or extracted. In some music, processing on a component for a individual frequency band sometimes offers an adverse effect to make the quality worse, or can hardly acquire the expected effect.

SUMMARY OF THE INVENTION

In view of these circumstances, the present invention has been made, and a general purpose of the invention is to provide a technique in which processing of a sound signal is diversified.

An embodiment of the present invention relates to a beat enhancement device. The beat enhancement device includes: a beat extractor which extracts a timing of a beat which provides a basis for a rhythm, based on a time derivative value of a spectrum of a sound signal currently being reproduced by a sound reproduction device, and acquires a peak of the time derivative value at the timing as an intensity of the beat; and an output signal generator which generates an output signal subjected to a certain processing in accordance with the beat intensity at the beat timing extracted by the beat extractor.

Herein, a "sound signal" is information forming the flow of sound with a rhythm and converted into an electric signal, and a sound source may be any one of a human voice, a sound of an instrument, and a handclap, or a combination thereof.

Another embodiment of the present invention relates to a sound output device. The sound output device includes: a beat extractor which extracts a timing of a beat which provides a basis for a rhythm, based on a time derivative value of a spectrum of a sound signal currently being reproduced by a sound reproduction device, and acquires a peak of the time derivative value at the timing as an intensity of the beat; an output signal generator which generates a beat enhanced sound signal in which at least part of frequency bands is amplified by a gain in accordance with the beat intensity at the beat timing extracted by the beat extractor; and a sound output unit which outputs the beat enhanced sound signal as a sound.

Still another embodiment of the present invention relates to an electronic apparatus. The electronic apparatus includes: a beat extractor which extracts a timing of a beat which provides a basis for a rhythm, based on a time derivative value of a spectrum of a sound signal currently being reproduced by a sound reproduction device, and acquires a peak of the time derivative value at the timing, as an intensity of the beat; an output signal generator which generates an oscillation signal having a waveform which oscillates with an amplitude in accordance with the beat intensity at the timing extracted by the beat extractor; and an oscillator which oscillates by the oscillation signal.

Still another embodiment of the present invention relates to an electronic apparatus. This electronic apparatus includes: a beat extractor which extracts a timing of a beat which provides a basis for a rhythm, based on a time derivative value of a spectrum of a sound signal currently being reproduced by a sound reproduction device, and acquires a peak of the time derivative value at the timing, as an intensity of the beat; an output signal generator which generates a light intensity signal of which waveform rises with a magnitude commensurate with the beat intensity at the timing extracted in the beat extractor unit; and a light emitting device which emits a light at the intensity of the light intensity signal generated by the output signal generator.

Still another embodiment of the present invention relates to a method of outputting a beat. The method of outputting a beat include: extracting a timing of a beat which provides a basis for a rhythm, based on a time derivative value of a spectrum of a sound signal currently being reproduced by a sound reproduction device, and acquiring a peak of the time derivative value at the timing as an intensity of the beat; generating an output signal including a waveform component of which amplitude increases with the degree in accordance with the intensity of the beat at the timing; and making a user feel a beat by outputting an output signal in at least any one of forms of a sound, an oscillation and a light emission.

Note that any combination of the aforementioned components or any manifestation of the present invention exchanged between methods, devices, systems, computer programs and so forth, is effective as an embodiment of the present invention.

DETAILED DESCRIPTION OF THE INVENTION

The invention will now be described by reference to the preferred embodiments. This does not intend to limit the scope of the present invention, but to exemplify the invention.

Embodiment 1

Figure 1:
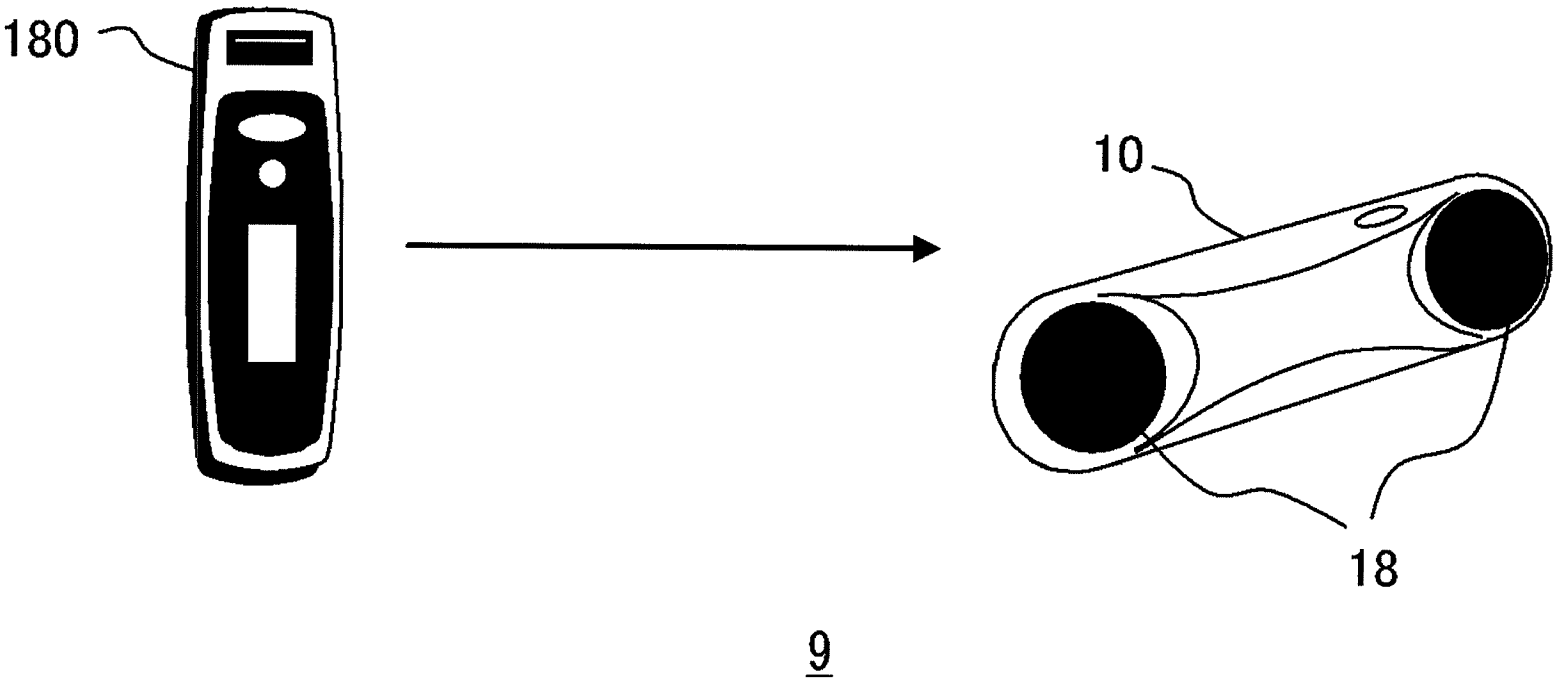
FIG. 1 is a diagram which shows a structure of a sound output system in the embodiment 1.

FIG. 1 shows a structure of a sound output system in the present embodiment. A sound output system 9 includes a sound reproduction device 180 and a sound output device 10. The sound reproduction device 180 has a memory function in which coded sound data is stored, and a reproducing function by which a piece of sound data, which is selected by a user, is reproduced so that a sound signal is output. For example, the device 180 may be a mobile audio player. These functions may be the same as those of a typical audio player. The sound reproduction device 180 only has to have the above functions and be capable of feeding a sound signal to the sound output device 10 and should not be limited to a mobile audio player.

Sound data reproduced by the sound reproduction device 180 may be read out from a recording medium such as a CD (Compact Disc), by a reading device (not shown), or be downloaded from a music content providing server or the like via a network (not shown), without being limited to data stored in a built-in flash memory or a hard disk. Alternatively, the sound data also may be directly input from a live performance etc., using a microphone (not shown) or the like, and then be subjected to A/D conversion. Hereinafter, such conversion is collectively referred to as a "reproduction". In any case, the sound reproduction device 180 outputs the sound specified by a user as a sound signal.

The sound output device 10 acquires a sound signal output by the sound reproduction device 180 as an input signal, and then output the sound signal from a sound output unit 18 as a sound, after performing a predetermined processing thereon. A sound signal input from the sound reproduction device 180 to the sound output device 10 may be carried out via either a cable or a wireless connection, thus may be optionally selected from methods normally used. In addition, the sound reproduction device 180 and the sound output device 10 may have their own cases respectively, as shown in FIG. 1, or they may be formed as one body to build a sound reproduction device provided with the sound output device 10. The sound output device 10 may be realized as a speaker as shown in the drawing, or may be a headphone or an earphone without being limited to a speaker, as long as the apparatus has a function described below and outputs a sound.

The sound output device 10 according to the present embodiment extracts a beat component from a sound signal input from the sound reproduction device 180, and outputs the sound signal as a sound after performing a processing thereon so that the beat component is enhanced. Herein, a beat component refers to a component in a sound signal which is considered to be a beat that is a time standard of music. Accordingly, the beat component appears approximately regularly at a certain timing; however, the timing may change as the music tempo changes. The sound output device 10 extracts beats which conform to a tempo that changes in real time in music currently being reproduced, as a "beat timing".

The present embodiment also takes a "beat intensity" into consideration. In general, a beat in a less dynamic part of a piece of music is not performed so intensively while a beat in a dynamic part thereof is performed intensively, and a person listening to the music can feel the change. With digitization of such a "beat intensity", the "beat intensity" is reflected in the degree to which a sound signal is enhanced, a change in music tones is addressed accordingly. Due to this, a sound in which a beat component is enhanced can be output without distorting the world created by a composer or a player. Furthermore, a sound signal can be applied with an enhancement processing from a new perspective of timing, which can bring an advantage that well-defined sound, which cannot be obtained by processing for respective frequency bands, can be generated.

Figure 2:
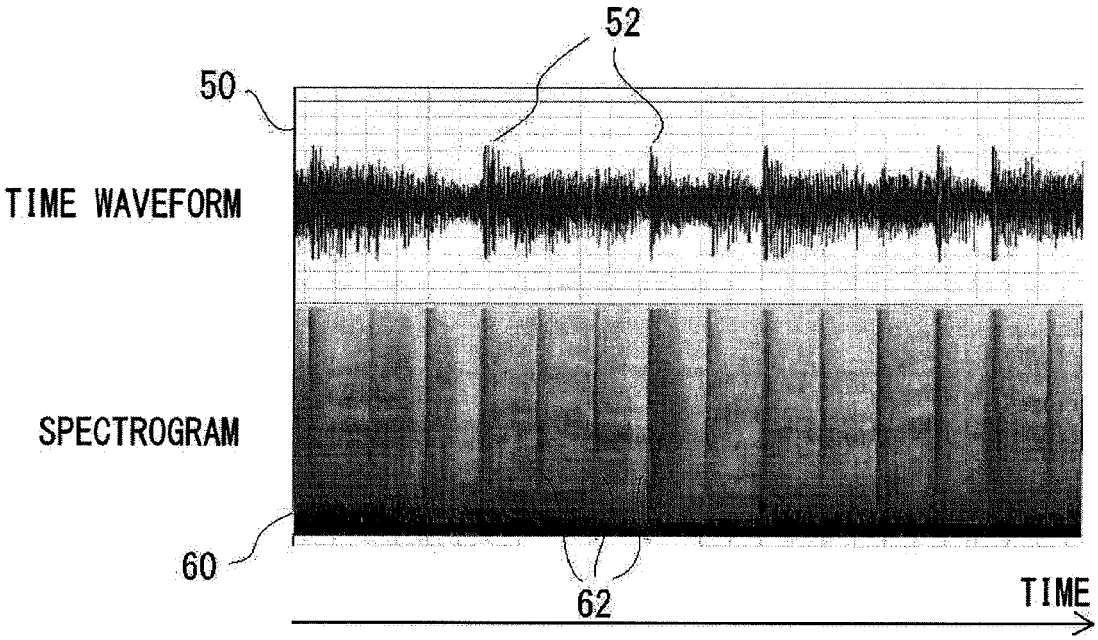
FIG. 2 is diagram which illustrates the principle of beat extraction used in the embodiment 1.

The way of extracting of beats is not particularly limited, as long as a beat timing is determined and a beat intensity at the timing can be represented by any indicator, as described above. One way of extracting beats using a spectrogram will be referred to below as an example thereof. FIG. 2 is a diagram which is intended to illustrate the principle of beat extraction used in the present embodiment. In the drawing, the top chart shows a time-waveform 50 of a sound signal, while the bottom chart a spectrogram 60 of the sound signal at the same time. The spectrogram 60 shows a time variation in a spectrum of a sound signal vs. frequency, in which the axis of ordinate represents frequency and the axis of abscissa represents time. In the drawing, the time axes of the top chart and the bottom chart are common.

From the time waveform 50, timings 52 at which the peaks thereof oscillate greatly are observed. This is considered the timing at which a percussion instrument, for example, a drum or the like, beats out. However, when actually listening to the music, beats can be felt at more timings than the beat timings 52 appearing in the time waveform in many cases. This is because the time waveform is formed by various sound waveforms of which the music is composed, the sound waveforms overlapping one another. In other words, the time waveform could change in its amplitude depending on a phase of each sound wave, therefore that waveforms could often counteract one another at a beat timing, or amplify themselves at a timing other than a beat timing. Hence, the extraction of beats is hardly carried out with a sufficient accuracy.

On the other hand, from the spectrogram 60, it can be observed that strong instantaneous spectra 62 occur approximately periodically over a wide range of frequency band. A timing at which the spectra 62 occur agrees with a beat timing which a person feels when really listening to the music. Therefore, in the present embodiment, a timing at which the spectra 62 appear is determined to be a beat timing. Specifically, a spectrum is subjected to time derivation, and a value, that is, a timing at which a time variation in the spectrum is large is determined to be a beat timing. And a time derivative value is determined to be a beat intensity.

Figure 3:
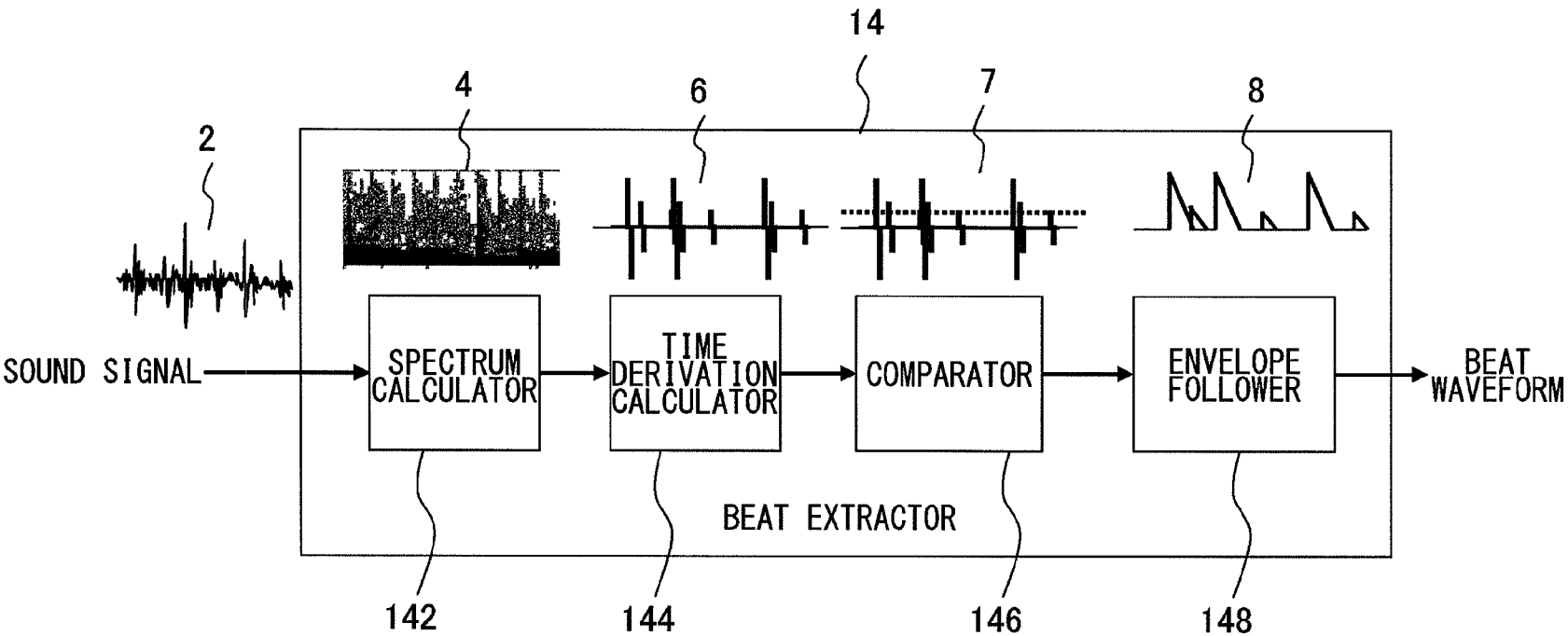
FIG. 3 is a diagram which shows a structure of a beat extractor which extracts a beat in the embodiment 1.

The process in which extraction of a beat is carried out will be described in detail below. FIG. 3 shows a structure of a beat extractor which extracts a beat. The beat extractor 14 is provided in the sound output device 10 along with other functions described later. The beat extractor 14 includes: a spectrum calculator 142 which calculates a value of a spectrum forming a spectrogram; a time derivation calculator 144 which subjects a spectrum to time derivation; a comparator 6 which determines a beat based on a time derivative value; and an envelope follower 148 which outputs the beat as a waveform so that processing for enhancing a sound is performed.

A sound signal input in the beat extractor 14 is at first input in the spectrum calculator 142, and a spectrum at each time is calculated by performing ordinary processing such as an FFT (Fast Fourier Transform) operation at every predetermined period. Then in the time derivation calculator 144, a time derivative value is calculated by calculating a variation value per a unit of time, with respect to the lump sum of a spectrum over the whole range of frequency band. Calculation in the spectrum calculator 142 and the time derivation calculator 144 may be carried out by the overlap process. The process calculates a spectrum for every sound signal sampled within a predetermined time period, and acquires as a time derivative value a spectrum difference which is obtained by shifting the predetermined time period shifted by a unit of time. The specified process in this case is disclosed in Patent Document (Japanese patent Application Publication No. 2007-33851), which was disclosed by the present inventor in the past. Thus, a spectrum with time resolution in the range of from several milliseconds to several tens of milliseconds can be obtained.

With the above calculations by the spectrum calculator 142 and the time derivation calculator 144, a spectrum as shown in the spectrogram 4 in the drawing is calculated from a sound signal having a waveform as represented by the waveform 2, then a time derivative waveform as represented by the waveform 6 can be obtained. The comparator 146 compares the peak of a time derivative value-waveform output from the time derivation calculator 144 with a threshold value set in derivation values in advance (waveform 7). A waveform having a peak exceeding the threshold value is extracted as a beat component. As a result, the extracted beat component includes information on a beat timing and a beat intensity at the timing.

In order to detect a beat timing more accurately, a threshold value is set to the optimum value based on comparison with the feeling obtained in real listening, and on the periodicity of the music. Alternatively, a threshold value may be selected from a plurality of set values depending on a music genre or the like, or the optimum value is determined by measuring a beat interval extracted after varying threshold value during the several beats at the beginning of music, then the determined value may be fed back to the subsequent processing.

The envelope follower 148 performs envelope processing on the waveform extracted by the comparator 146, and generates and outputs a waveform (waveform 8) which rises at a beat timing and is attenuated at a slower speed than that of rise. A rise width of the waveform expresses the peak of a time derivative value, i.e., an intensity of a beat. An attenuation speed is set so that a waveform which has risen returns to zero level in, for example, in tens to hundreds of milliseconds. The optimum value of speed may be determined according to time resolution of beat extraction, etc., or be selected from a plurality of set values depending on a tune or a genre or the like of the music to be reproduced. An attenuation speed of music may be adjusted, for example, if the music has heavy beats, the speed is to be fast in order to make the waveform of the music steeper. Hereinafter, a waveform output by the envelope follower 148 is referred to as a beat waveform.

The waveform generation processing performed by the envelope follower 148 is one in which a time at which a beat is enhanced is given a predetermined width so that a user can recognize a beat timing. Therefore, a commonly used pulse generator can be used to generate a pulse having another form, such as a rectangle wave or a triangular wave, which has a predetermined time width, instead of the envelope follower 148. In addition, measures may be taken to ensure that a beat waveform is similar to a time variation in a spectrogram. For example, for a beat which produces a strong spectrum in a spectrogram followed by slow attenuation, i.e., a beat with a small negative peak in a time derivative value following a positive peak, the attenuation speed in the beat waveform may be reduced accordingly.

Figure 4:
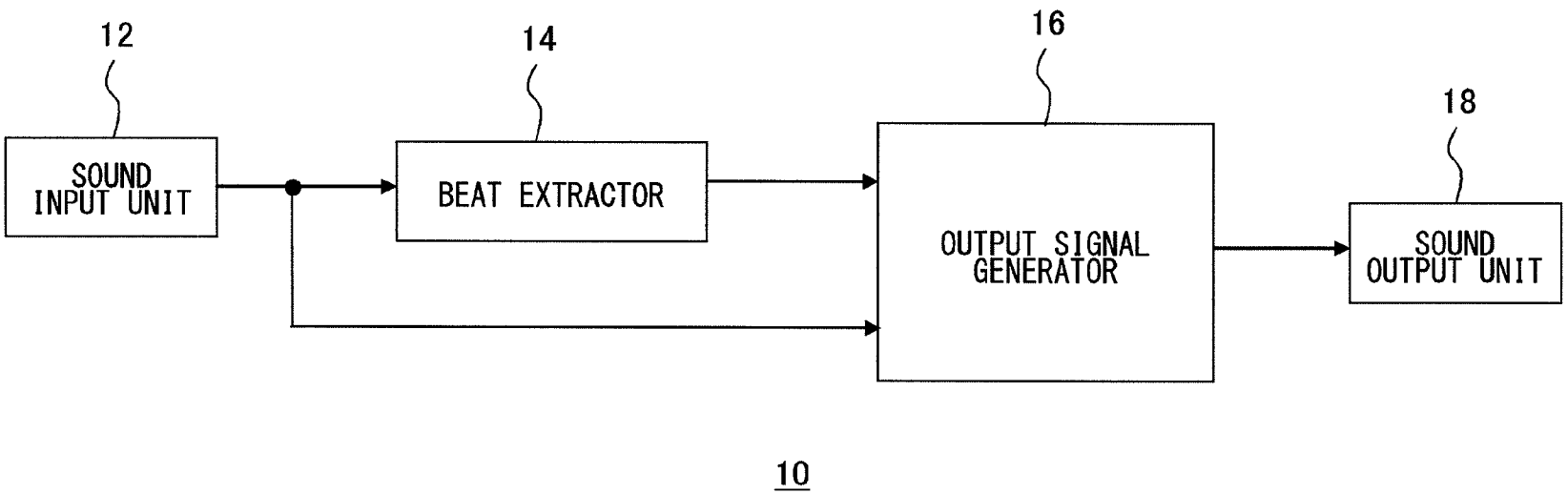
FIG. 4 is a diagram which shows a structure of a sound output device in the embodiment 1.

Enhancement processing of a sound signal currently being reproduced is carried out with the use of a beat waveform thus generated. FIG. 4 shows a structure of the sound output device 10 in the present embodiment. The sound output device 10 includes: a sound input unit 12 which acquires a sound signal from the sound reproduction device 180; a beat extractor 14 illustrated in FIG. 3; an output signal generator 16 which generates a beat enhanced sound signal in which a beat component of a sound signal currently being reproduced is enhanced; and a sound output unit 18 which outputs a beat enhanced sound signal as a sound.

In the sound input unit 12, a sound signal reproduced through decryption etc. in the sound reproduction device 180 is input via a cable or a wireless connection as described above. A sound signal input in the sound input unit 12 is input in the beat extractor 14 and the output signal generator 16. The beat extractor 14 generates a beat waveform based on the sound signal input by the above processing, and outputs the beat waveform to the output signal generator 16.

The output signal generator 16 amplifies the sound signal input from the sound input unit 12, with a beat waveform input from the beat extractor 14 being a gain, and at a beat timing and a beat intensity of the beat waveform. A frequency band to be amplified may be all of the frequency bands of a sound signal, or be only a specific frequency band. For example, a frequency band characteristic of the music currently being reproduced may be amplified. A frequency band that a specific musical instrument such as a drum has may be amplified. A frequency band characteristic of music can be realized by reading out the information added beforehand to sound data as metadata. A frequency band to be amplified may be selected by a user. The output signal generator 16 may be realized by a commonly used equalizer capable of performing time control.

The output signal generator 16 uses the absolute value of the amplitude of a beat waveform, which is to be a gain, for amplifying a sound signal, after appropriately normalizing the absolute value so that enhancement of a beat waveform be suitable. Alternatively, the degree of enhancement may be adjusted by a user with the use of an adjustment knob (not shown) provided in the sound output device 10, or the like.

The sound output unit 18 outputs a beat enhanced sound signal input from the output signal generator 16, as a sound, after performing D/A conversion on the beat enhanced sound. The sound output unit 18 may be implemented by a commonly used speaker, earphone and headphone, etc. With a structure described above, the sound output unit can output a sound signal as a sound after performing processing on the sound signal reproduced by the sound reproduction device 180, in which a beat component of the sound signal is enhanced.

Figure 5:
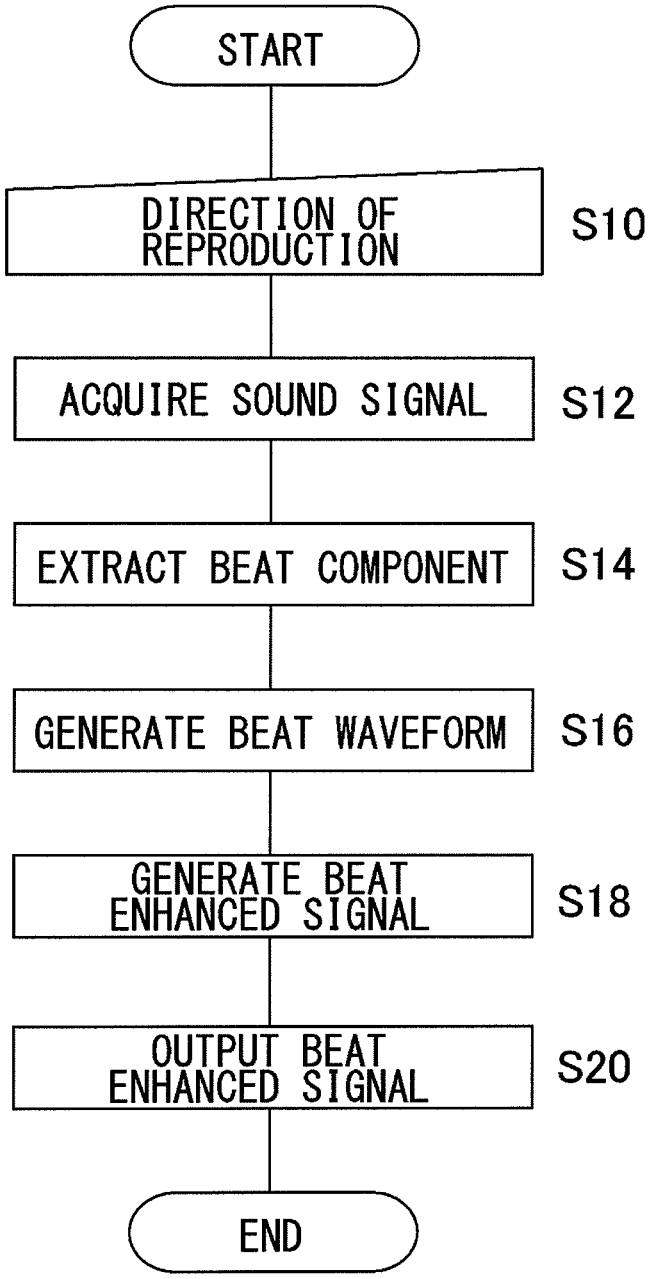
FIG. 5 is a flowchart which shows processing procedures performed by a sound output device in a sound output system in the embodiment 1.

FIG. 5 shows processing procedures performed by the sound output device 10 in the sound output system 9, with the structure described above. First, when a user inputs a direction of reproduction to the sound reproduction device 180 after selecting sound data (S10), the sound reproduction device 180 performs decoding of the sound data, etc., and inputs a sound signal into the sound output device 10. When acquiring the sound signal (S12), the sound output device 10 performs beat component extraction processing, such as spectrum calculation, time derivation, beat determination, etc. (S14), and generates a beat waveform (S16).

Subsequently, the sound output device 10 generates a beat enhanced sound signal in which at least a predetermined frequency band of the sound signal is amplified with the beat waveform of the sound signal being a gain (S18), and outputs it as a sound (S20).

According to the present embodiment described above, after acquiring a beat timing and a beat intensity included in a sound signal currently being reproduced, the enhancement processing of the sound signal is performed at the timing and in accordance with the intensity. By detecting a beat component of a reproduced sound signal in real time and performing enhancement processing dynamically in accordance with its timing and intensity, only a beat can be enhanced without spoiling the ethos which the original music has, therefore well-defined music can be enjoyed in accordance with user's liking or the situation of a sound output device or the like.

Moreover, it becomes possible to determine a beat timing more accurately with a relatively simple circuit structure by the inventive method in which using a spectrogram for extracting a beat component, a timing at which a peak in the waveform of a time derivative value of a spectrum exceeds a certain threshold, is determined as a beat timing. As a result, a clearer feel of a beat can be obtained, as compared with the case where a beat is detected from, for example, a time waveform of a sound.

For example, in the technology of enhancing a specific frequency band exclusively, such as a low frequency amplifier filter, there are problems in that a desired effect cannot be obtained and sound quality is even worsened. This is because only a sound signal in a certain frequency band is monitored and processed and, in addition to that, constantly subjected to enhancement processing, regardless of the frequency band of the input audio signal. For example, there might be such a case where even if you try to enhance sounds of a drum to obtain a feel of a beat, sounds of another low frequency instrument in the same frequency band are also enhanced, ultimately making the total sounds vague or muffled. Also there might be a case where the total sound is distorted temporarily depending on a change in sound volume. On the other hand, the present embodiment has advantages in that a sound providing a feel of a beat and rhythm can be listened without the whole sound quality being greatly affected, and in addition to that, a sound is hard to be distorted, because a change in the whole frequency band is detected as a beat and an enhancement processing is performed only at a beat timing.

Based on the foregoing, it will be appreciated that "catchiness" is felt more intensely, in particular, in such a genre of modern music in which rhythm is important, such as hip-hop, dance music, rock, or pops. Furthermore, when considering other music genres, a way of enhancing music which matches the music tone can be changed according to the circumstances, because a frequency band to be enhanced or the degree of enhancement is to be changeable. With a beat portion being enhanced accurately, a user can have a feeling of surely listening to the music even if the user were in an environment where a total volume of music should be low or music is difficult to listen to because of surrounding noises. Similarly, a user can have a feeling of listening to a powerful sound even with a small-sized speaker or an earphone.

Embodiment 2

In the embodiment 1, a beat component including information of a beat timing and a beat intensity is extracted from a sound signal, and a sound signal of which a beat is enhanced is generated and output as a sound, by amplifying part or the whole of frequency band of a sound signal in accordance with the beat component. In the present embodiment, a sound signal of which a beat component is enhanced is output in a form other than sound, specifically, in a form of oscillation of an oscillator. Hereinafter, the present embodiment will be described below, designating the same components as in the embodiment 1 with the same numeral references, and omitting the repeated description appropriately.

Figure 6:
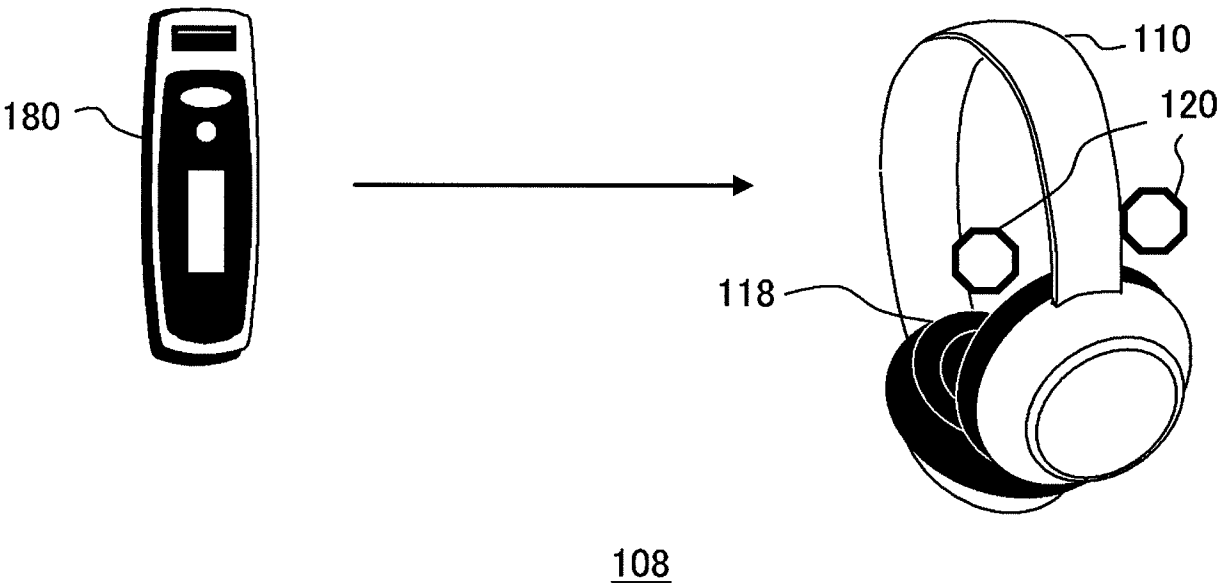
FIG. 6 is a diagram which shows a structure of a sound output system in the embodiment 2.

FIG. 6 shows a structure of a sound output system in the present embodiment. The sound output system 108 includes: a sound reproduction device 180; and a headphone 110. The sound reproduction device 180 is the same as that of the sound reproduction device 180 explained in the embodiment 1. The headphone 110 makes a user putting on the headphone 110 listen to a sound by acquiring a sound signal reproduced by the sound reproduction device 180 as an input signal, and outputting it as a sound from the sound output unit 118. This function can be realized with the same structure as that of a usual headphone. The headphone 110 in this embodiment is further provided with an oscillator 120. The headphone 110 converts a sound signal input into an oscillation signal of which a beat is enhanced, and outputs the signal as an oscillation of the oscillator 120.

In the present embodiment, a sound output system outputs a waveform of a sound signal which is amplified in accordance with a beat intensity at a beat timing as an oscillation. The embodiment does not simply introduce a device which works monotonously at a beat timing. Moreover, the system outputs a waveform of a sound signal as an oscillation also at timing other than a beat timing. That is, the system always gives an oscillation in accordance with a waveform of a sound signal to the oscillator. Therefore, as an oscillator 120, an oscillator capable of following an oscillation with a frequency band up to about 20 kHz which a sound signal has, can be used, for example, an electromagnetic type oscillator.

In the sound output system 108 shown in FIG. 6, a user can feel an oscillation in his/her head by implementing the oscillator 120 in the headphone 110; however, devices other than a headphone can be used in this embodiment, as long as a user can feel an oscillation by putting on the devices. Any device selected from, for example, a small-sized speaker which can be put into a pocket or the like, a controller of a game device or the like, a mobile phone, a wrist watch or the like, may be used. Alternatively, a device which indirectly communicates an oscillation to a user by oscillating a desk, floor, wall, or a belonging of the user or the like, can be used, if a device does not directly communicate an oscillation to a user. In the following description, the headphone 110 will represent such electronic devices.

Figure 7:
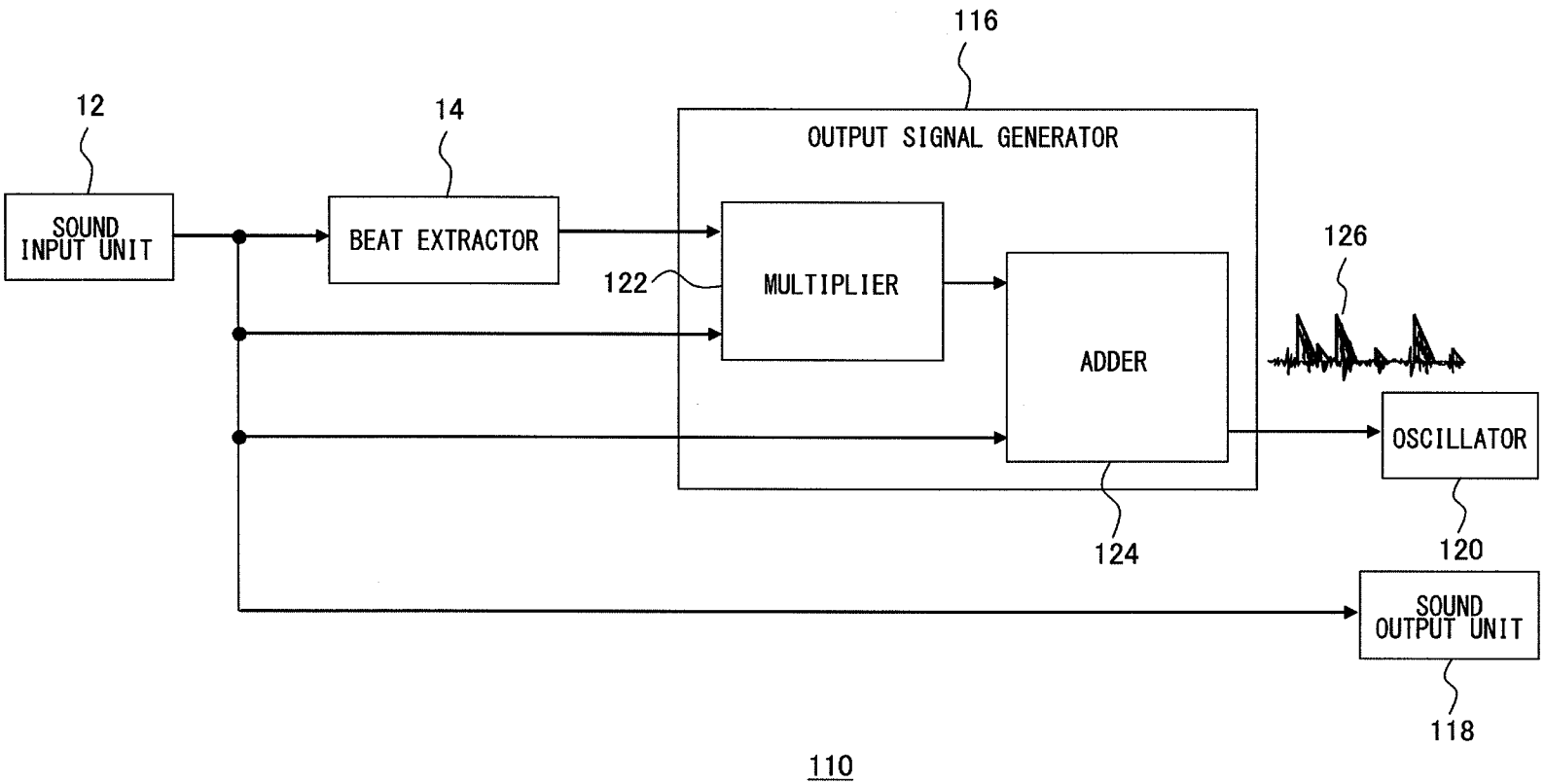
FIG. 7 is a diagram which shows a structure of a headphone in the embodiment 2.

FIG. 7 shows a structure of the headphone 110 in the present embodiment. The headphone 110 includes: a sound input unit 12 which inputs a sound signal from the sound reproduction device 180; a beat extractor 14 which extracts a beat component of a sound signal; an output signal generator 116 which generates an oscillation signal of which beat component is enhanced; an oscillator 120 which oscillates by the oscillation signal; and a sound output unit 118 which outputs an original sound signal as a sound. In the case where a sound and an oscillation are output in a form other than the headphone 110, the oscillator 120 and the sound output unit 118 may either be one body or have separate cases.

The sound input unit 12 and the beat extractor 14 have the same structures and functions as described in the embodiment 1. The output signal generator 116 includes a multiplier 122 and an adder 124. As described above, an oscillation signal in the present embodiment basically reflects a waveform of a sound signal. The amplitude of the oscillation signal is made to be greater in accordance with a beat intensity at a beat timing. For this purpose, a beat waveform output by the beat extractor 14 and a sound signal output by the sound input unit 12 are first input into the multiplier 122, then these two are subjected to multiplication. Thus, a signal having a waveform like a waveform 126 is obtained, in which the signal oscillates at the frequency of the sound signal and the amplitude thereof changes in a form of the beat waveform as a whole.

In a waveform of a signal thus generated, there is no oscillation during a period after the attenuation of the waveform of a given beat until the waveform of the subsequent beat rises. Then, the adder 124 further adds the waveform of a sound signal output by the sound input unit 12, to the wave form generated by the multiplier 122. Thereby, a signal which oscillates in a waveform of a sound signal during the period other than a beat, and in which the amplitude thereof is amplified at a beat timing, can be obtained. In addition, processing of changing the waveform into an electric signal which oscillates an oscillator with a suitable amplitude, is also performed here. The output signal generator 116 outputs an oscillation signal thus generated. Although the adder 124 desirably adds the waveform of a sound signal as described above, it may also be acceptable in some cases that a monotonous oscillation waveform prepared beforehand is added. It is also desirable in this case that the oscillation has a higher frequency than that of a beat waveform.

A sound signal to be input to the adder 124 may be a sound signal output by the sound input unit 12 as described above, or, alternatively, a sound signal through a filter (not shown) which extracts a specified frequency band, or through an equalizer (not shown) which varies a frequency characteristic, may also be sufficient. In the latter case, adjustment of an oscillation during a time other than a beat is possible by setting a frequency band or a balance which is suitable for oscillation of an oscillator 120 or with which a user can feel comfortable, by experiments etc. in advance. A sound signal input to the multiplier 122 may also be subjected to the same processing. In addition, the maximum amplitude of an oscillation signal may be adjusted by a user with an adjustment knob (not shown) provided in the headphone 110, as well as being preset by experiments, etc.

An oscillation signal output from the output signal generator 116 is input into the oscillator 120, allowing an oscillation to be realized. Strictly speaking, the oscillator 120 oscillates in the same way as the waveform of an oscillation signal, driven by an oscillation generator (not shown) included in the oscillator 120. At the time, the sound output unit 118 outputs the original sound signal input from the sound input unit 12 as a sound. The oscillation of the oscillator 120 and the sound output from the sound output unit 118 are naturally synchronized with each other such that the level of synchronization can be recognized by people. Thereby, a user can feel simultaneously an oscillation of which a beat of a music is enhanced, while listening to the music with the headphone 110.

According to the present embodiment described above, a sound signal currently being reproduced is output as an oscillation of a oscillator. The oscillation in the case is one in which a waveform of a sound signal is reflected as it is. Moreover, after acquiring a beat timing and a beat intensity included in the sound signal, the amplitude of the oscillation is amplified in accordance with the beat intensity at the beat timing, thereby allowing a user to feel an oscillation which matches the music well and of which beat is enhanced, while listening to the music. For example, when music is of the genre of hip-hop, rock or the like, a user can feel a beat which moves the body as if he/she were in a concert hall.

For example, a conventional sensory sound unit, such as a body sonic unit, is designed to make a person feel a oscillation of a low frequency in the range of about several Hz to hundreds Hz for the purpose of, for example, giving the feeling of being there while watching a movie. Therefore, the oscillation is always output during the time when a sound of the low frequency band exists. On the other hand, in the present embodiment, a user can enjoy a well-defined oscillation, since an oscillation in which a desired frequency band of a sound signal is amplified at a detected beat timing is output. For example, by designing the whole frequency band of sound signals to be amplified, a user can feel the beat of music as an oscillation with music of any frequency band alike.

Moreover, the present embodiment can make a user feel a beat more clearly in the form of oscillation, since a spectrogram is used for extraction of a beat component in the same way as with the embodiment 1. As a result, a user can obtain a feeling as if he/she were listening to a live performance, especially while listening to modern music, a genre in which the rhythm is important, such as hip-pop, dance music, rock, pops, etc. Moreover, the present embodiment can deal with various music expressions, such as a human voice not so rich in low frequency components and a rhythm expression using a high frequency instrument, since a beat is detected from variation in a spectrum across the whole frequency band.

Moreover, in the present embodiment, an oscillation can start or stop at a resolution level of tens of milliseconds and so a beat timing can be more faithfully reflected, since an oscillation is output by an oscillator instead of a motor. Moreover, the present embodiment can realize an oscillation in which the waveform of a sound signal is turned into motions as it is, therefore the embodiment can provide a novel experience in which music can be enjoyed with an oscillation.

Embodiment 3

In the embodiment 1, a beat component is extracted from a sound signal and a sound signal of which a beat is enhanced is output as a sound. In the embodiment 2, a beat is output as an oscillation of an oscillator by providing an oscillation signal of which a beat is enhanced to the oscillator, in addition to an ordinary sound output. In the present embodiment, a beat is output after visualizing it in the form of light emission. Hereinafter, the present embodiment will be described below, designating the same components as in the embodiment 1 with the same numeral references, and omitting the repeated description appropriately.

The present embodiment can be practiced by using an electronic apparatus which is provided with a light emitting device that emits a light at an intensity corresponding to a beat intensity at a beat timing. Therefore, the electronic apparatus may be one in which a light emitting device is provided in the sound output device 10 in the sound output system 9 shown in FIG. 1, or in the headphone 110 in the sound output system 108 shown in FIG. 6. Alternatively, the embodiment may be applied to other electronic apparatuses, such as a mobile audio player, a controller of a game device, a computer, or a wrist watch. Hereinafter, an example in which a mobile phone is used as a sound output device will be described.

Figure 8:
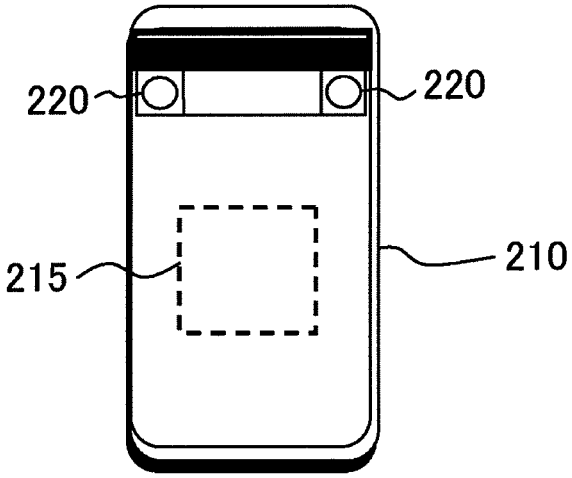
FIG. 8 is a diagram which shows a structure of a mobile phone in the embodiment 3.

FIG. 8 shows a structure of a mobile phone in accordance with the present embodiment. A mobile phone 210 includes a light emitting device 220. However, the outlook of the mobile phone 210, such as the location of the light emitting device 220, is not limited to what is illustrated. Besides that, the mobile phone 210 includes a sound reproducing module 215.

The sound reproducing module 215 may be a module provided in an ordinary mobile phone, as long as the module has the same function as that of the sound reproducing apparatus 180 in the embodiments 1 and 2, and is capable of recording and reproducing sound data.

Figure 9:
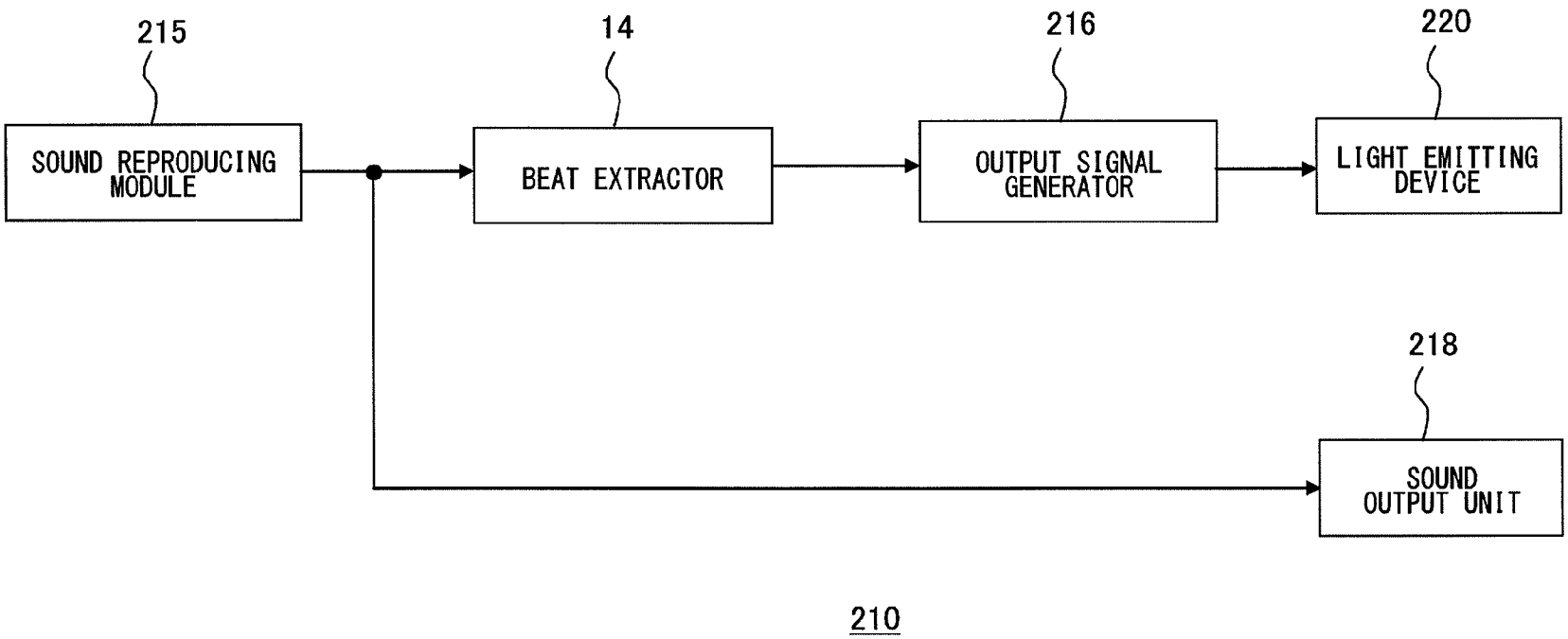
FIG. 9 is a diagram which shows in detail a structure of a mobile phone in the embodiment 3.

FIG. 9 shows the structure of the mobile phone 210 in detail. In the drawing, a module which provides a normal function, such as the function of placing and receiving a call, which a mobile phone usually has, is not illustrated. The mobile phone 210 includes: a sound reproducing module 215 which reproduces sound data; a beat extractor 14 which extracts a beat component of a sound signal; an output signal generator 216 which generates a light emitting intensity signal which is composed of a beat component of a sound signal; a light emitting device 220 which emits light by an light emitting intensity signal; and a sound output unit 218 which outputs an original signal as a sound.

The beat extractor 14 has the same structure and function as described in the embodiment 1. The output signal generator 216 generates and outputs an electric signal which has the same waveform as the beat waveform input from the beat extractor 14, and has an amplitude which makes the light emitting device 220 emit light at a suitable intensity. The light emitting device 220 may be composed of a light emitting diode etc., which are generally used in a mobile phone etc., and emits light at the intensity defined by a light emitting intensity signal input from the output signal generator 216. The sound output unit 218 may be a commonly used speaker etc., which is provided in a mobile phone etc., and outputs a sound signal input from the sound reproducing module 215 as a sound. Light emission from the light emitting device 22 and sound output from the sound output unit 218 are naturally synchronized with each other such that the level of synchronization can be recognized by people.

Thereby, upon receiving a call on the mobile phone 210, a user can recognize the receipt of a call visually by light emission at a timing synchronized with the beat of the music, as well as by hearing the music set for receiving a call. For example, when music is set so as to have a different tone depending on a call sender, a user can determine a call sender by the timing or intensity of light emission, even if sound output is suspended by the manner mode or the like.

The present embodiment described above outputs a sound signal currently being reproduced as a light emitting. The light emission is performed at the timing of a beat included in a sound signal, and the intensity thereof is also reflected the intensity of the sound signal. The timing and intensity of the light emission are based on a beat waveform obtained with the use of a spectrogram, therefore emission and suspension of a light can be successfully distinguished, allowing a user to visually recognize a well-defined feel of beat. In addition, a user can visually enjoy a beat expression with light that better matches music even by a simple structure of a light emission device alone, because the intensity of light emission is changed in real time according to a sound signal currently being reproduced.

Embodiment 4

In the embodiments 2 and 3, a beat component included in a sound signal currently being produced is output as an oscillation or an emission of light, while an original sound signal is being output as a sound. On the other hand, making a beat felt with an oscillation or an emission of light has various advantages even if no sound signal is output. Furthermore, a variety of merits can be obtained by optionally combining an output of an enhanced sound signal in which a beat component of a sound signal is enhanced, an output of an oscillation of an oscillator, or an output of light emission of an light emitting device, as mentioned in the embodiment 1. Yet another embodiment will be hereinafter described in which the components to realize these functions can be selected appropriately or a user can arbitrarily set the functions on or off.

Figure 10:
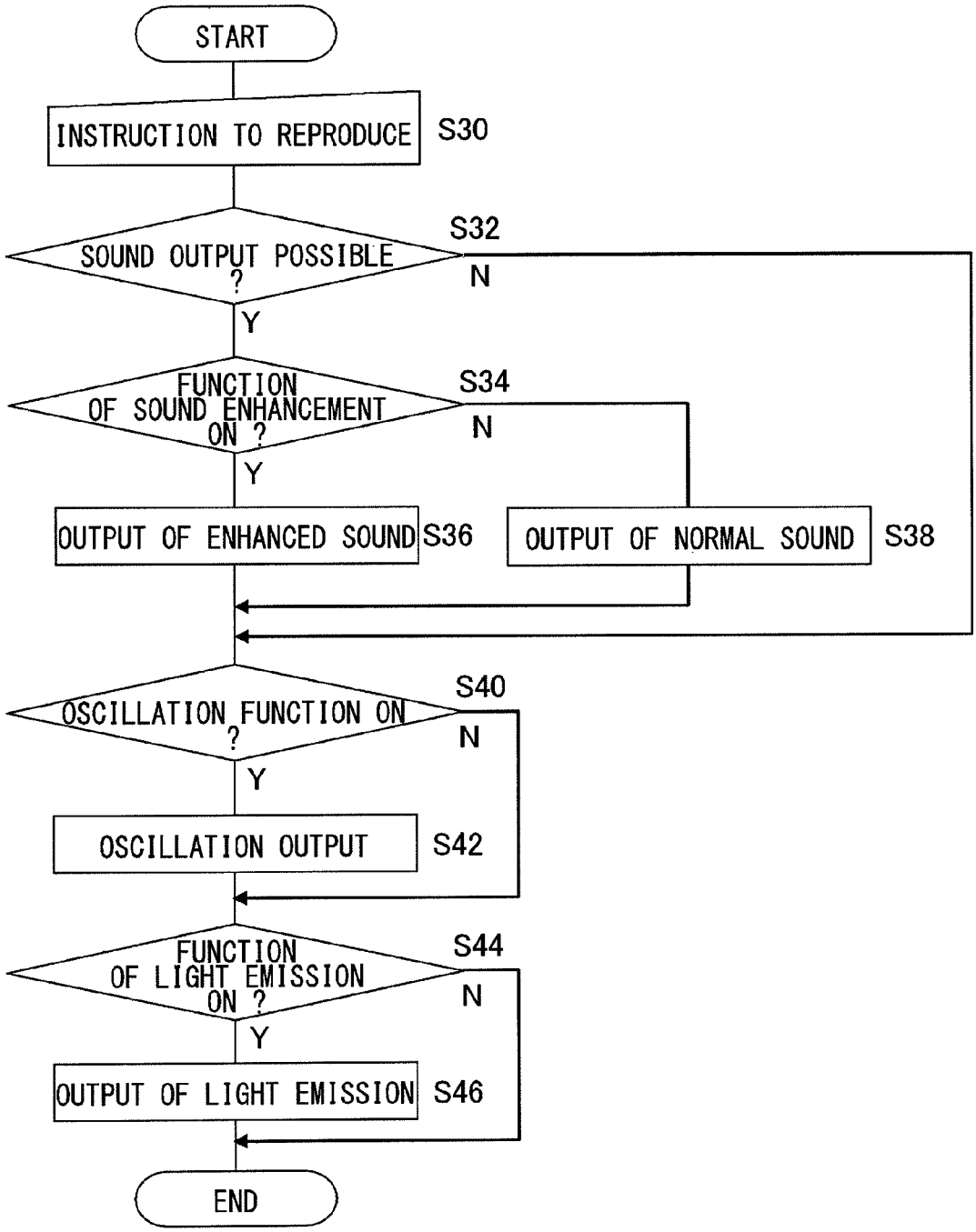
FIG. 10 is a flowchart which shows processing procedures performed by a sound output device in the embodiment 4.

FIG. 10 shows the processing procedure which a sound output device in the present embodiment performs. The sound output device in the present embodiment is implemented by a device having the same structure as the sound output device 10 described in the embodiment 1, the headphone 110 described in the embodiment 2, and the mobile phone described in the embodiment 3 etc., or having part of the structure thereof, or having a combination thereof. Examples include an oscillation device having a structure other than that of the sound output unit 118 provided in the headphone 110 described in the embodiment 2, a light emitting device having a structure other than that of the sound output unit 218 provided in the headphone 210 described in the embodiment 3, or an oscillation and light emission device obtained by a combination thereof. Furthermore, a mobile phone or a mobile audio player etc., may also be used in which the structure of the mobile headphone 210 described in the embodiment 3 is additionally provided with the oscillator 120 and the output signal generator 116 provided in the headphone 110.

FIG. 10 is a flowchart which shows a change of the processing procedure caused by difference in such structures, or by a user's selection of function. In the latter case, it is assumed that an input button, with which a user can select an ON/OFF of each function, is provided in a device by which the processing is performed. At first, after selecting the sound data, a user provides an instruction to reproduce the sound data to the sound output device or a sound reproducing device provided in another system (S30). When sound output is possible because the sound output device is provided with a speaker or the like (S32/Y), and when generation of a beat enhanced sound signal is possible because the sound output device is provided with the block including the beat extractor 13 and the output signal generator 16 of the device 10 of FIG. 4, and when a user selects ON of the function (Y in S34), a sound signal of which a beat component is enhanced is output as a sound (S36). On the other hand, when a beat enhanced sound signal cannot be generated, or a user selects OFF of the function (S34/N), a reproduced sound is simply output (S38). If a sound output function is not provided, or a user suspends the function (S32/N), the processing of S36 and S38 is nor performed.

Furthermore, when extraction of a beat component and generation of an oscillation signal are possible because the block including the beat extractor 14 and the output signal generator 16, and the oscillator 120 of the headphone in FIG. 7, are provided, and when a user selects ON of the function (S40/Y), a beat component is output as an oscillation of an oscillator by performing the processing described in the embodiment 2 other than a sound output (S42). On the other hand, when an oscillation signal cannot be generated or a user selects OFF of the function (S40/N), the processing of S42 is not performed.

In addition, when extraction of a beat component and generation of a light emission intensity signal are possible because the block including the beat extractor 14 and the output signal generator 216, and the emitting device 220 of the mobile phone 210 in FIG. 9 are provided, and when a user selects ON of the function (S44/Y), a beat component is output as a light emission of a light emitting device by performing the processing described in the embodiment 3 other than output of a sound signal (S46). On the other hand, when generation of a light emission intensity signal cannot be generated or a user selects OFF of the function (S44/N), the processing of S46 is not performed.

Thus, a user can obtain various effects according to the situation by combining a sound output of a beat component, an output of an oscillation, and an output of a light emission, as necessary, or by user's selection between ON and OFF of the function. Music can be enjoyed in a new way where only a feel of a beat can be enjoyed without listening to the music. For example, an output device of music may be an oscillation device without output of a sound, or a mobile phone may be set to output only an oscillation because sound output is set to be OFF in the phone. Further it is possible to determine a call sender by identifying the music which is played upon receiving a call with oscillation. As described in the embodiment 2, by oscillating on oscillator in a waveform of a sound signal, the well-defined music can be "listened to" with the touch sense through an oscillation coming from an oscillator, allowing music with heavy beats to be enjoyed by, for example, a person with hearing impairment, or in a public space where sound of the music cannot be allowed.

Because a beat component is automatically extracted using a spectrogram, a beat timing and a beat intensity sometimes could be new parameters of which music is composed—parameters that a creator of the music would never have dreamt as such—in addition to conventional parameters, such as a tone color, a musical interval, a note length, of which music is composed. When paying attention to this point, a parameter of a beat conversely can be used for music expression.

Furthermore, by adopting an output method of light emission, which is described in the embodiment 3, in lighting, changes of lighting can be automatically controlled so as to be synchronized in real time with music, in a concert hall or dance party hall, or the like.

As described above, the present invention is explained based on the embodiments. The above embodiments are only exemplary, therefore it should be understood by a person skilled in the art that various modifications are possible in combining the aforementioned components or the processes, such combinations are also within the scope of the present invention.

What is claimed is:

1. A beat enhancement device comprising:

a beat extractor which extracts a timing of a beat which provides a basis for a rhythm, based on a mathematical time derivative value of a spectrum of a sound signal currently being reproduced by a sound reproduction device, and acquires a peak of the time derivative value at the timing as an intensity of the beat; and an output signal generator which generates an output signal subjected to a certain processing with a degree which increases proportional to the beat intensity at the beat timing extracted by the beat extractor which is the peak of the time derivative value.

2. An electronic apparatus comprising:

a beat extractor which extracts a timing of a beat which provides a basis for a rhythm, based on a mathematical time derivative value of a spectrum of a sound signal currently being reproduced by a sound reproduction device, and acquires a peak of the time derivative value at the timing, as an intensity of the beat;

an output signal generator which generates an oscillation signal having a waveform which oscillates with an amplitude which increases proportional to the beat intensity at the timing extracted by the beat extractor which is the peak of the time derivative value; and an oscillator which oscillates by the oscillation signal.

3. The electronic apparatus according to claim 2, wherein the beat extractor generates a beat waveform which rises with a magnitude commensurate with the beat intensity at the beat timing, and is attenuated at a slower speed than that of rise, and wherein the output signal generator generates an oscillation signal which has an amplitude in accordance with the magnitude of the beat waveform, and oscillates at a higher frequency than that of the beat waveform.

4. The electronic apparatus according to claim 2, wherein the output signal generator generates an oscillation signal which has a waveform including a frequency component which the waveform of the sound signal has.

5. The electronic apparatus according to claim 2, wherein the oscillation signal generated by the output signal generator includes a waveform component of at least part of frequency band of the sound signal.

6. The electronic apparatus according to claim 2, further comprising a sound output unit which outputs the sound signal as a sound.

* * * * *